US010249950B1

(12) United States Patent
Arnitz et al.

(10) Patent No.: US 10,249,950 B1
(45) Date of Patent: Apr. 2, 2019

(54) SYSTEMS AND METHODS FOR REDUCED CONTROL INPUTS IN TUNABLE META-DEVICES

(71) Applicant: Searete LLC, Bellevue, WA (US)

(72) Inventors: Daniel Arnitz, Seattle, WA (US); Joseph Hagerty, Seattle, WA (US); Russell J. Hannigan, Sammamish, WA (US); Guy S. Lipworth, Seattle, WA (US); Matthew S. Reynolds, Seattle, WA (US); Yaroslav A. Urzhumov, Bellevue, WA (US)

(73) Assignee: Searete LLC, Bellevue, WA (US)

( * ) Notice: Subject to any disclaimer, the term of this patent is extended or adjusted under 35 U.S.C. 154(b) by 0 days.

(21) Appl. No.: 15/706,697

(22) Filed: Sep. 16, 2017

(51) Int. Cl.
*H01Q 3/44* (2006.01)
*H01Q 21/29* (2006.01)
*H01Q 21/06* (2006.01)

(52) U.S. Cl.
CPC ..... *H01Q 3/446* (2013.01); *H01Q 21/061* (2013.01); *H01Q 21/29* (2013.01)

(58) Field of Classification Search
CPC ..... H01Q 3/446; H01Q 21/29
USPC ..... 341/850
See application file for complete search history.

(56) References Cited

U.S. PATENT DOCUMENTS 5,441,532 A 8/1995 Fenn
6,533,733 B1 3/2003 Ericson et al.
6,879,693 B2 4/2005 Miller et al.
7,924,226 B2 * 4/2011 Soler Castany ..... H01Q 1/38 343/700 MS
7,928,900 B2 4/2011 Fuller et al.
8,504,138 B1 8/2013 Pivonka et al.
8,847,840 B1 9/2014 Diaz
9,252,492 B2 * 2/2016 Alrabadi ..... H01Q 9/0421
(Continued)

OTHER PUBLICATIONS

Arnitz, Daniel and Matthew S. Reynolds, "Wireless Power Transfer Optimization for Nonlinear Passive Backscatter Devices," 2013 IEEE International Conference on RFID, 2013, p. 245-252, Department of Electrical and Computer Engineering, Duke University, Durham, NC, U.S.A.

(Continued)

*Primary Examiner* — Peguy Jean Pierre
(74) *Attorney, Agent, or Firm* — Phillips, Ryther & Winchester; Justin K. Flanagan

(57) ABSTRACT

In some embodiments, an antenna system includes antenna elements for transmitting and/or receiving electromagnetic radiation. The antenna elements may be connected to a feed via a plurality of tunable impedance elements. At least some of the tunable impedance elements may have nonlinear responses to impedance tuning that can be numerically approximated by nonlinear impedance-tuning parameter curves with a cumulative number of selectable nonlinear coefficients. Control inputs to nonlinearly vary impedance values of the tunable impedance elements allow for the selection of distinct impedance patterns that correspond to distinct field patterns attainable by the antenna system. The number of field patterns attainable is a function of the number of control inputs and a cumulative number of selectable nonlinear coefficients. Thus, a selection of tunable impedance elements and control inputs may be made to attain a target number of field patterns to serve a desired coverage area.

35 Claims, 12 Drawing Sheets

(56) References Cited

U.S. PATENT DOCUMENTS

| | | | |
|---|---|---|---|
| 9,917,376 | B2 | 3/2018 | Belmkaddem et al. |
| 2003/0011515 | A1 | 1/2003 | Warble et al. |
| 2004/0162034 | A1 | 8/2004 | Parker |
| 2004/0201526 | A1* | 10/2004 | Knowles ..... H01Q 1/38 343/700 MS |
| 2007/0288066 | A1 | 12/2007 | Christman et al. |
| 2008/0015421 | A1 | 1/2008 | Penner |
| 2010/0022861 | A1 | 1/2010 | Cinbis et al. |
| 2010/0262160 | A1 | 10/2010 | Boyden et al. |
| 2010/0262239 | A1 | 10/2010 | Boyden et al. |
| 2010/0301971 | A1 | 12/2010 | Yonak et al. |
| 2010/0324378 | A1 | 12/2010 | Tran et al. |
| 2011/0087306 | A1 | 4/2011 | Goossen |
| 2013/0154558 | A1 | 6/2013 | Lee et al. |
| 2014/0039277 | A1 | 2/2014 | Abraham |
| 2014/0306784 | A1 | 10/2014 | Broyde et al. |
| 2014/0334565 | A1 | 11/2014 | Tzanidis et al. |
| 2014/0340732 | A1 | 11/2014 | Zhang et al. |
| 2015/0029133 | A1 | 1/2015 | Yeh et al. |
| 2015/0091706 | A1 | 4/2015 | Chemishkian |
| 2015/0130285 | A1 | 5/2015 | Leabman et al. |
| 2015/0171516 | A1 | 6/2015 | Chen et al. |
| 2016/0074196 | A1 | 3/2016 | Forsell |
| 2016/0344240 | A1 | 11/2016 | Yeh et al. |
| 2017/0063344 | A1 | 3/2017 | Broyde et al. |
| 2017/0063439 | A1 | 3/2017 | Frank |

OTHER PUBLICATIONS

Arnitz, Daniel and Matthew S. Reynolds, "Multitransmitter Wireless Power Transfer Optimizaiton for Backscatter RFID Transponders," IEEE Antennas and Wireless Propagation Letters, 2013, p. 849-852, vol. 12, IEEE.

Arnitz, Daniel and Matthew S. Reynolds, "MIMO Wireless Power Transfer for Mobile Devices," Pervasive Computing, 2016, p. 36-44, IEEE CS.

* cited by examiner

SYSTEMS AND METHODS FOR REDUCED CONTROL INPUTS IN TUNABLE META-DEVICES

If an Application Data Sheet (ADS) has been filed on the filing date of this application, it is incorporated by reference herein. Any applications claimed on the ADS for priority under 35 U.S.C. §§ 119, 120, 121, or 365(c), and any and all parent, grandparent, great-grandparent, etc., applications of such applications are also incorporated by reference, including any priority claims made in those applications and any material incorporated by reference, to the extent such subject matter is not inconsistent herewith.

CROSS-REFERENCE TO RELATED APPLICATIONS

The present application claims the benefit of the earliest available effective filing date(s) from the following listed application(s) (the "Priority Applications"), if any, listed below (e.g., claims earliest available priority dates for other than provisional patent applications or claims benefits under 35 U.S.C. § 119(e) for provisional patent applications, for any and all parent, grandparent, great-grandparent, etc., applications of the Priority Application(s)). In addition, the present application is related to the "Related Applications," if any, listed below.

PRIORITY APPLICATIONS

None

RELATED APPLICATIONS

This application relates to and hereby incorporates by reference in their entireties: U.S. patent application Ser. No. 14/918,331 filed on Oct. 20, 2015 titled "Tunable Metamaterial Systems and Methods;" U.S. patent application Ser. No. 15/253,606 filed on Aug. 31, 2016 titled "Tunable Medium Linear Coder;" U.S. patent application Ser. No. 15/409,401 filed on Jan. 18, 2017 titled "Tunable Medium Linear Coder;" U.S. patent application Ser. No. 15/048,878 filed on Feb. 19, 2016 titled "Transmitter Configured to Provide a Channel Capacity that Exceeds a Saturation Channel Capacity;" U.S. patent application Ser. No. 15/048,880 filed on Feb. 19, 2016 titled "Receiver Configured to Provide a Channel Capacity that Exceeds a Saturation Channel Capacity;" U.S. patent application Ser. No. 15/048,884 filed on Feb. 19, 2016 titled "System with Transmitter and Receiver Remote From One Another and Configured to Provide a Channel Capacity that Exceeds a Saturation Channel Capacity;" U.S. patent application Ser. No. 15/048,888 filed on Feb. 19, 2016 titled "System with Transmitter and Receiver Configured to Provide a Channel Capacity that Exceeds a Saturation Channel Capacity;" U.S. patent application Ser. No. 15/345,251 filed on Nov. 7, 2016 titled Massively Multi-User Mimo Using Space-Time Holography;" and U.S. patent application Ser. No. 15/409,394 filed on Jan. 18, 2017 titled Massively Multi-User Mimo Using Space-Time Holography." Many of the embodiments and variations disclosed in the related applications can be used in combination with and/or by modified by the systems and methods disclosed herein.

If the listings of applications provided above are inconsistent with the listings provided via an ADS, it is the intent of the Applicant to claim priority to each application that appears in the Priority Applications section of the ADS and to each application that appears in the Priority Applications section of this application.

All subject matter of the Priority Applications and the Related Applications and of any and all parent, grandparent, great-grandparent, etc., applications of the Priority Applications and the Related Applications, including any priority claims, is incorporated herein by reference to the extent such subject matter is not inconsistent herewith.

TECHNICAL FIELD

The present disclosure generally relates beamforming via reconfigurable antennas comprising subwavelength antenna elements connected to tunable impedance elements whose impedance values are nonlinearly variable by one or more control inputs.

DETAILED DESCRIPTION

The present disclosure provides various embodiments, systems, apparatuses, and methods that relate to radiation and electromagnetic field patterning. Electromagnetic field patterning may be useful for wireless power transfer, data transfer, control signal communication, and the like. In many implementations, an antenna is used to send and/or receive electromagnetic radiation within a coverage area (e.g., a three-dimensional space). In some implementations, it is useful to use beamforming to increase the selectivity of an antenna system. Multiple, selectable beamforms may be used to attain a desired coverage area while still realizing the advantages of beamforming.

A generic example of using a narrow beamform to serve a relatively large coverage area is a parabolic dish antenna system. By adding a gimble to the system, a controller may change the azimuth and/or elevation of the parabolic dish antenna system to service a wide coverage area with a plurality of distinct beamforms or radiation patterns. The relatively slow mechanical movement of the parabolic dish antenna system to adjust the azimuth and/or elevation limits its use and applicability for certain applications.

A phased array of antennas can allow for the generation of a plurality of distinct field patterns within a coverage area. A phased array includes multiple complete antennas each connected to a phase shifter. Thus, a phased array is many times larger than a single antenna and requires a common controller, power divider, and a phase shifter for each antenna in the array. The size and complexity of phased arrays limit their potential uses and general applicability to a small subset of practical applications.

Tunable metamaterial devices may be used to solve various electromagnetic field-based issues. By tuning individual elements of a densely-packed metamaterial array, a wide variety of customizable radiation patterns may be attained. In many instances, metamaterial elements are used as example embodiments of sub-wavelength antenna elements. It is, however, appreciated that any of a wide variety of sub-wavelength antenna elements may be utilized that may or may not be classified as metamaterials.

As described in various embodiments below, an antenna system may include a plurality of antenna elements for transmitting and/or receiving electromagnetic radiation. A tunable port network comprising a plurality of tunable impedance elements may connect the antenna elements to a feed.

Figure 1:
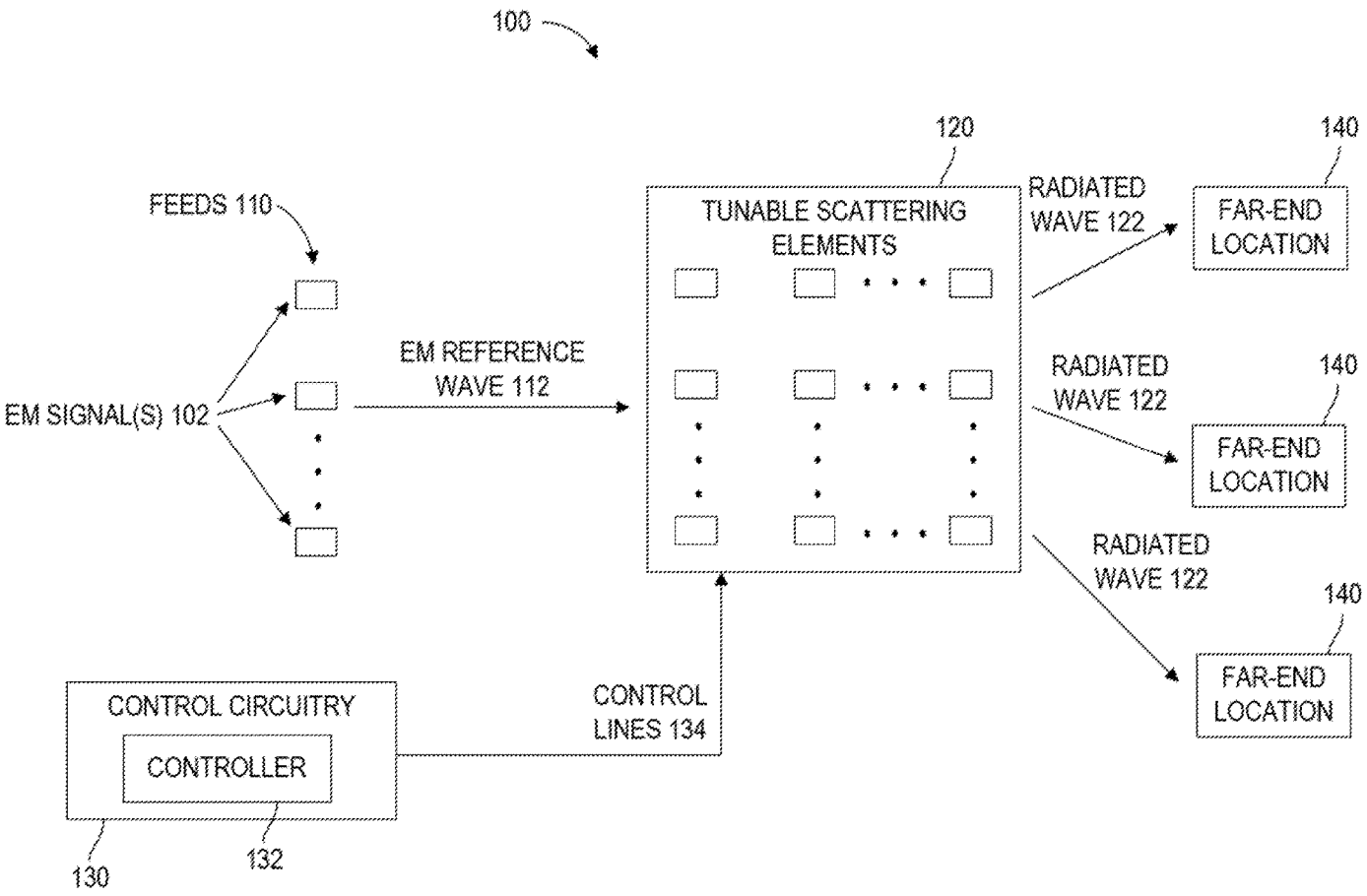
FIG. 1 is a simplified block diagram of an antenna system, according to various embodiments.

FIG. 1 is a simplified block diagram of an antenna system 100 according to some embodiments. The antenna system 100 includes one or more feeds 110 configured to receive EM signals 102 (e.g., one or more EM signals 102) and propagate an EM reference wave 112 to a plurality of tunable EM scattering elements 120 of the antenna system 100. The EM scattering elements 120 may include antenna elements and associated tunable impedance elements. In various embodiments, the plurality of tunable EM scattering elements 120 are spaced at sub-wavelength distances (e.g., at less than or equal to about a half wavelength of an operational frequency, at less than or equal to a quarter wavelength of the operational frequency, etc.). The plurality of tunable EM scattering elements 120 are configured to operate in at least two different operational states and may have a nonlinear response to impedance tuning. The EM scattering elements 120 are configured to selectively scatter the EM reference wave as a radiated wave 122. As used herein, the term "operational frequency" refers to a fundamental frequency of the radiated wave in freespace (e.g., through the air).

The antenna system 100 also includes control circuitry 130 including a controller 132 operably coupled to the plurality of tunable EM scattering elements 120 by a plurality of control lines 134. In some embodiments, the controller 132 can be used to modulate the radiated wave 122 over time to deliver a plurality of different information streams to a plurality of different far-end locations 140 by modulating the plurality of tunable EM scattering elements 120 between the plurality of different operational states over time. In other words, an information stream from the radiated wave 122 received at some of the different far-end locations 140 may be different from an information stream from the radiated wave 122 received at others of the different far-end locations.

Figure 2:
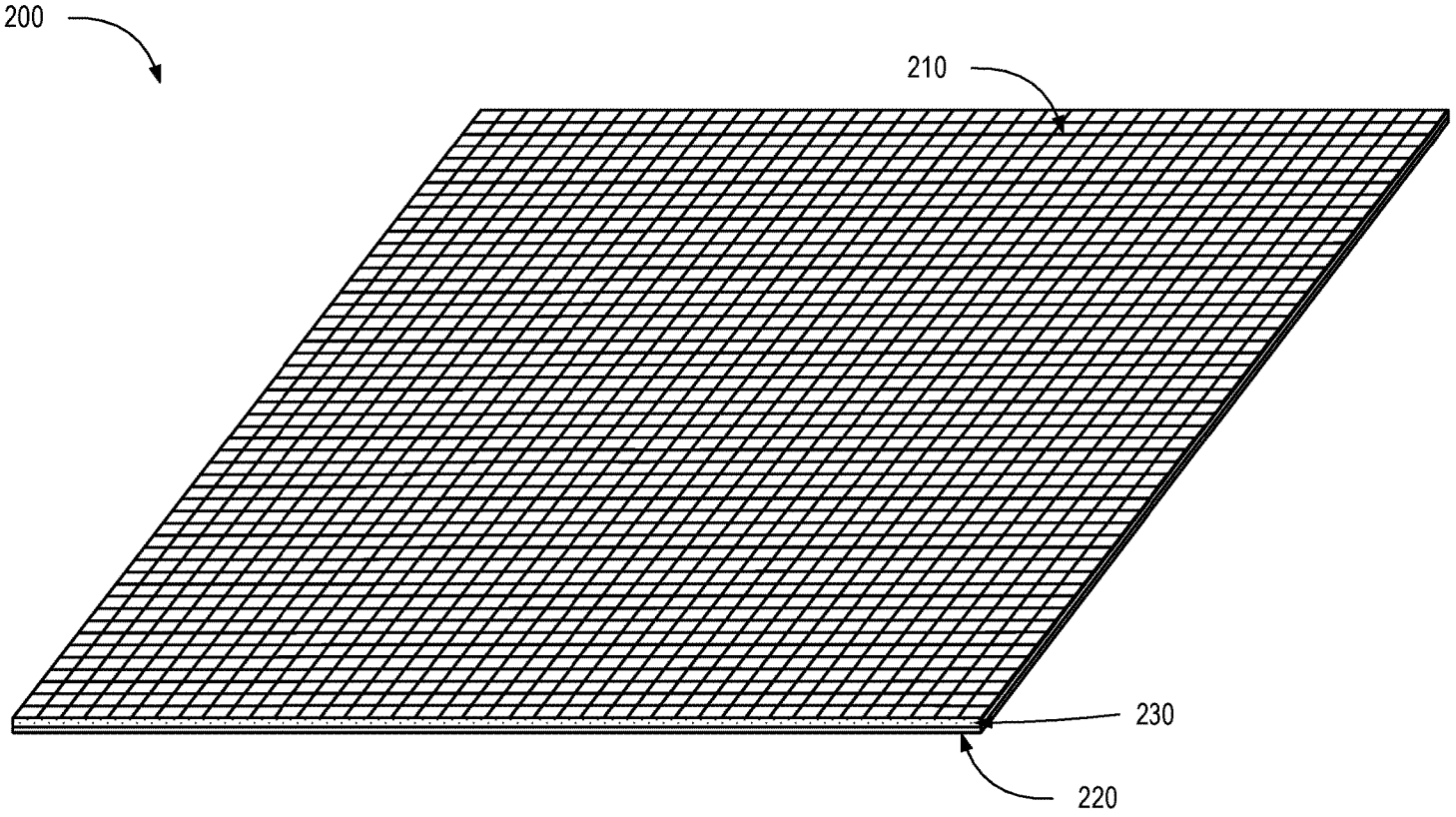
FIG. 2 is a simplified example of an antenna system with an array of subwavelength antenna elements for radiation patterning, according to one embodiment.

As previously described, the system 100 can be modeled as a plurality of antenna elements for scattering a radiated wave coupled to the feeds 110 via tunable impedance elements (e.g., tunable impedance elements). FIG. 2 is a simplified example of an antenna system 200 with an array of subwavelength antenna elements 210 on a top surface for scattering a radiated wave. A bottom layer 220 represents the feed and a middle layer 230 represents the tunable impedance elements (at least some of which may have a nonlinear response to impedance tuning) connecting the feed 210 to the antenna elements.

The tunable impedance elements may be numerically approximated by impedance-tuning parameter curves with a cumulative number of coefficients. Control lines may be connected to the tunable impedance elements to control the impedance values thereof. Accordingly, a controller can manipulate a plurality of control inputs to select from a plurality of distinct impedance patterns of the tunable impedance elements.

In the embodiments described above, the number of possible distinct impedance patterns is at least partially a function of the number of control inputs, which is in turn a function of the cumulative number of selectable nonlinear coefficients associated with the tunable impedance elements. The number of possible distinct impedance patterns can be described in terms of the degrees of freedom of the system. Each distinct impedance pattern couples the feed to the antenna elements in a different way that results in a unique radiation pattern.

In various embodiments, the number of control lines may be equal to the number of tunable impedance elements, such that each tunable impedance element can be individually tuned via a control line. At a basic level, a single control line may be configured to be toggled between an on state and an off state. The single control line may be connected to a single tunable impedance element. With the control line in the off state, the tunable impedance element may have a first impedance (optionally approaching infinity). With the control line in the on state, the tunable impedance element may have a second impedance that couples the feed to an antenna element. The degrees of freedom are very limited in this basic example.

In more complex embodiments, a control line may provide a variable input (e.g., stepped or continuously variable voltages between 0 and 5 volts) to a single tunable impedance element that has a nonlinear response to control input changes. In such an embodiment, a large number of degrees of freedom are possible. A network of tunable impedance elements that have nonlinear responses to impedance tuning via control inputs may provide a large number of degrees of freedom.

Figure 3A:
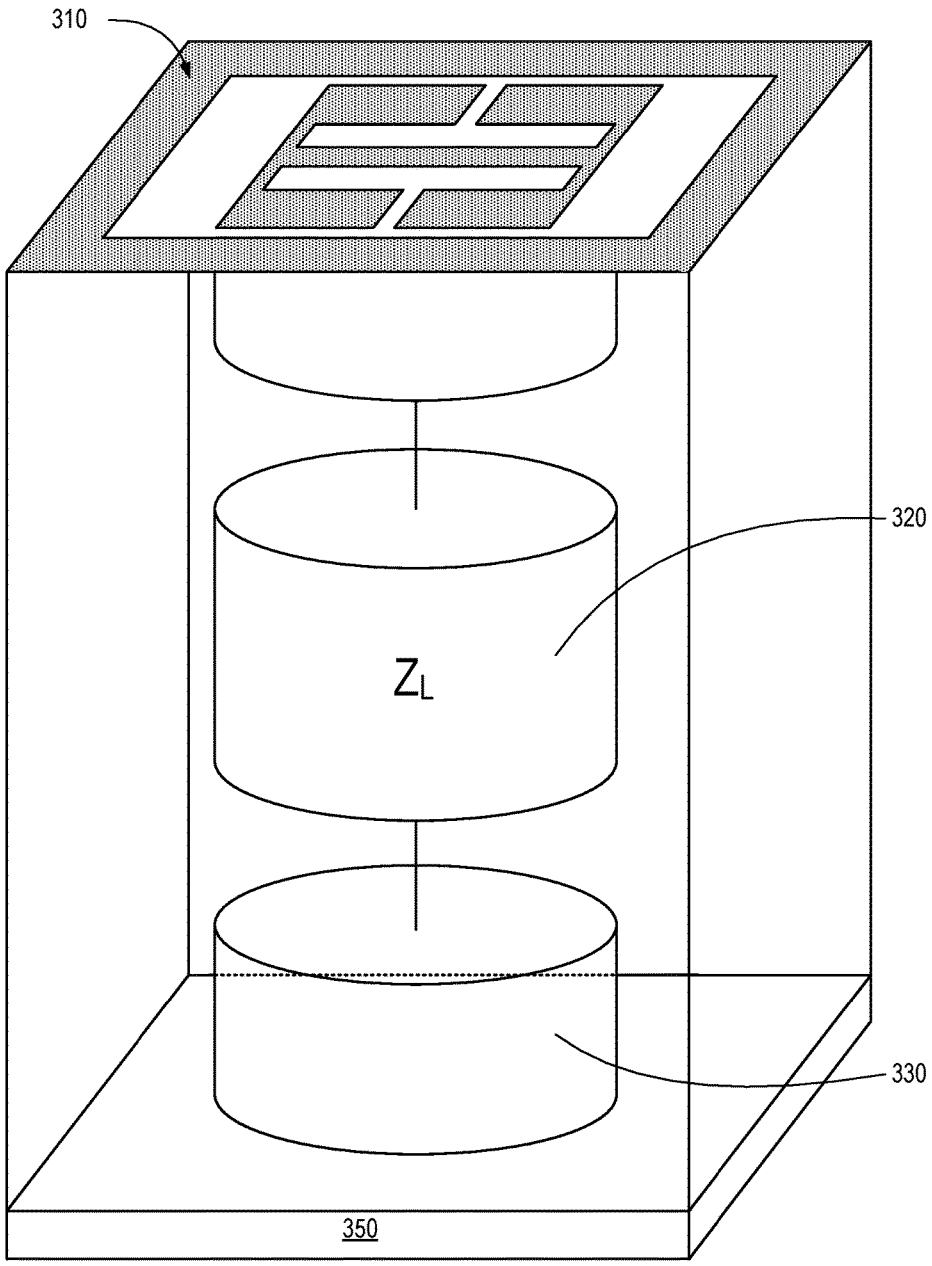
FIG. 3A illustrates a conceptual model a single subwavelength antenna element coupled to a tunable impedance element, according to one simplified embodiment.

FIG. 3A illustrates a conceptual model of a single subwavelength antenna element 310 for scattering an EM wave. A cylinder represents a tunable impedance element 320 that couples, at 330 the subwavelength antenna element 310 to a feed 350. The tunable impedance element 320 may be connected to a unique control line and exhibit a nonlinear response to changes in input stimuli from the control line.

The number of degrees of freedom in such a configuration can be determined by modeling the tunable impedance elements that have a nonlinear response to impedance tuning with nonlinear impedance-tuning parameter curves that include a plurality of selectable nonlinear coefficients. The number of degrees of freedom of the antenna system corresponds to the number of unique impedance patterns possible and is a function of the number of selectable nonlinear coefficients associated with each control input and/or tunable impedance element.

An antenna system for beamforming may produce a beamform (i.e., radiation pattern) that can be steered through a coverage zone. The number of unique radiation patterns needed to serve a particular coverage zone depends on the directivity of the antenna system and the size of the coverage zone. Antenna systems with higher directivities may need a larger number of field patterns to serve a particular coverage zone. Yet, higher directivities may provide improved selectivity and other advantages in various applications (e.g., communication, power transfer, imaging, etc.).

An antenna system may be designed to have a target directivity and coverage area. Given the directivity of the antenna system (and corresponding beamwidth) and the target coverage area, a number of distinct field patterns needed to serve the coverage area can be calculated. Each distinct field pattern corresponds to a unique impedance pattern produced by the tunable impedance elements. Thus, the number of unique impedance patterns needed corresponds to the target number of distinct field patterns for a particular system. As previously described, the tunable impedance elements of the antenna system can be numerically approximated with nonlinear impedance-tuning parameter curves with a cumulative number of selectable nonlinear coefficients. A number of control lines, $N_{CL}$, may provide control signals to each tunable impedance element. One or more of the tunable impedance elements may have a nonlinear response to impedance tuning.

The degrees of freedom of the antenna system to produce unique impedance patterns is a function of the number of control lines, the number of tunable impedance elements, and nonlinearity characteristics of the tunable impedance elements. The required degrees of freedom needed for a particular application is based on the number of distinct field patterns necessary to serve a coverage area, given a specific antenna directivity. The required degrees of freedom can be shifted from the tunable elements to the static parts of the structure, described by an RF admittance matrix, to reduce fabrication costs and/or the complexity of the control network.

In many of the embodiments discussed below, it is assumed that the control input to each tunable impedance element is provided by a unique control line. However, in some embodiments, a single control line may provide control inputs to multiple tunable impedance elements. For example, a single control line may provide control signals to multiple varactors in series. Liquid crystal-filled metamaterial resonators may be connected in parallel on a single DC line. In still other embodiments, multiple resonant elements may be affected by a single "pool" of a liquid crystal or a single flake of a semiconductor crystal. A single control line may bias the pool of liquid crystal or the flake of semiconductor crystal. In such embodiments, the number of tunable lumped elements may be different than the number of control lines, $N_{CL}$.

Figure 3B:
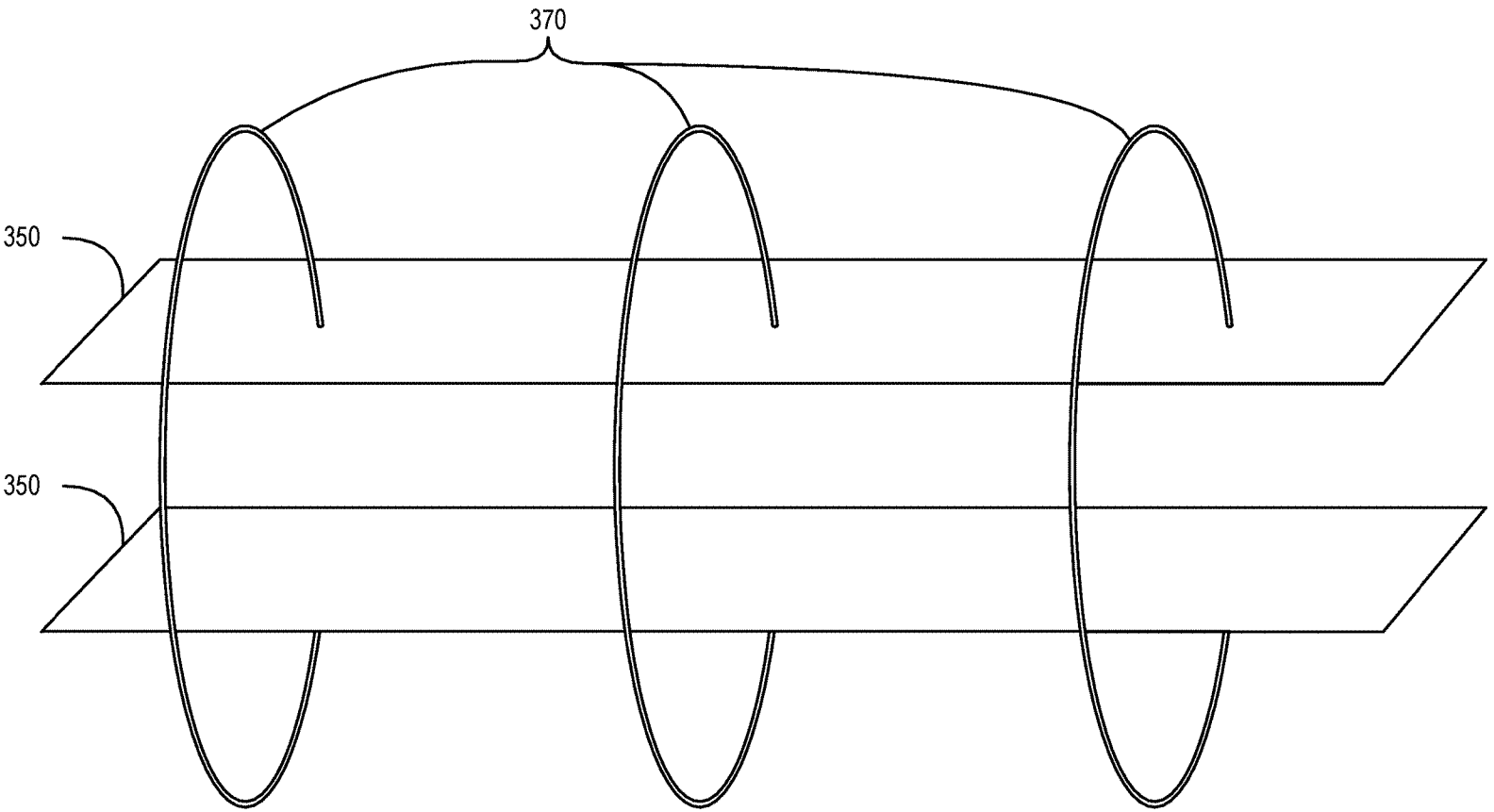
FIG. 3B illustrates a conceptual model of a plurality of resonant antenna elements coupled to a single tunable impedance element, according to one embodiment.

FIG. 3B illustrates a conceptual model of a plurality of resonant antenna elements 370 coupled to a single tunable impedance element formed by parallel plates 350, according to one embodiment. In such an embodiment, a control line may provide a control signal to the parallel plates to modify an impedance value associated therewith.

As described herein, electromagnetic reconfigurable antennas may be used for a wide variety of applications, such as communication, wireless power transfer, medical device control and communication, etc. Additional examples of uses for reconfigurable antenna systems include radar applications, three-dimensional tomography, selective electromagnetic illumination, structured illumination imaging (transmit and/or receive), etc. As previously noted, conventional phased array architectures and steerable arrays, including passive and active, have a modular structure in which the number of tunable phase shifters is equal to the number of amplifiers/attenuators and the number of radiating elements. Such architectures can be used to provide quasi-continuous beam steering coverage throughout a selected solid angel in the far field.

The antenna system may be specifically adapted to operate at (approximately) one specific wavelength in a quasi-monochromatic configuration, a target bandwidth, and/or at a plurality of discontiguous bandwidths along the electromagnetic spectrum. As specific embodiments, an antenna system as described herein may be part of a radar or other electromagnetic imaging system. An antenna system may be adapted to operate in a traditional radar band, such as the HF band (3-30 MHz), the VHF band (30-300 MHz), the UHF band (300-1000 MHz), the L band (1-2 GHz), the S Band (2-4 Ghz), the C band (4-8 GHz), the X band (8-12 GHz), the Ku band (12-18 GHz), the K band (18-27 GHz), Ka (27-40 GHz), or even the millimeter (mm) band (40-300 GHz). In some embodiments, the antenna system may be configured to operate at a specific bandwidth within one of the radar bands. In other embodiments, the antenna system may be configured to selectively operate within two or more contiguous bands. In still further embodiments, the antenna system may be configured to selectively operate within two or more discontiguous bands.

In some embodiments, one or more embodiments or combinations thereof may be adapted specifically for continuous wave (CW) near-field active imaging. For example, in a transmit mode or as a stand-alone transmitter, an antenna system may be configured to function as a structured illuminator to selectively illuminate a portion or portions of a target. Structured illumination may be further used for compressed sensing and single- or few-pixel imaging. In a receive mode or as a stand-alone receiver, an antenna system may be configured to function as a coded-aperture receiver in the decimeter, centimeter, and/or millimeter bandwidths. In some embodiments, it may be desirable to use a continuous wave (e.g., quasi-monochromatic) for near-field imaging.

In still other embodiments, an antenna system may be configured as part of a penetrating radar system to penetrate a material object (e.g., ground, rocks, water, dirt, sand, walls, concrete, etc.). Such an antenna system may be part of a subsurface imaging system (SSI system). One or more radio frequency bandwidth(s) may selected to maximize the resolution for a given depth of penetration. In some embodiments, a subsurface imaging system and the accompanying antenna system may be capable of functioning in one or more selectable bandwidths or even monochromatic or quasi-monochromatic wavelength(s). Generally speaking, a tradeoff is made between resolution and the ability to penetrate the material object.

For example, for ground-penetrating radar systems, higher frequencies generally provide a higher resolution, but cannot penetrate as far into the ground as lower frequencies. Using the antenna system described herein, ground-penetrating radar frequencies may be beamformed for structured illumination at a specific location within the ground. Similarly, a coded-aperture receiver may be used to receive ground-penetrating radar frequencies from specific locations within the ground. Frequencies may include those between approximately 100 MHz and 3000 MHz, depending on a desired penetration and/or resolution.

An SSI system may be used for a wide variety of application. For example, An SSI system may be used for security screening. In such an embodiment, the material object that is penetrated may be, for example, a box, a package, a case, a suitcase, a briefcase, and/or a bag. The SSI system may be used for human subject screening for subsurface imaging and penetration of clothes, protective garments, underwear garments, and/or biological tissues. The SSI system may be used for medical or veterinarian imaging and configured to penetrate clothes, protective garments, underwear garments, skin, fur, hair, muscle tissue, fatty tissue, bone, and/or biological tissues.

Conceptually, an antenna system utilizing a network (e.g., an array) of tunable impedance elements to selectively couple a feed to antenna elements (e.g., resonant antenna elements) can be modeled as an analog memory device storing a predefined number of holograms. Predefined combinations of input stimuli via control inputs to the tunable impedance elements allow for the selection of various impedance patterns corresponding to various radiation patterns. Within this conceptual framework, it is appreciated that the number of possible radiation patterns is a function of the number of unique combinations of input stimuli via the control input(s) and the degrees of freedom available via the tunable impedance elements.

Figure 4A:
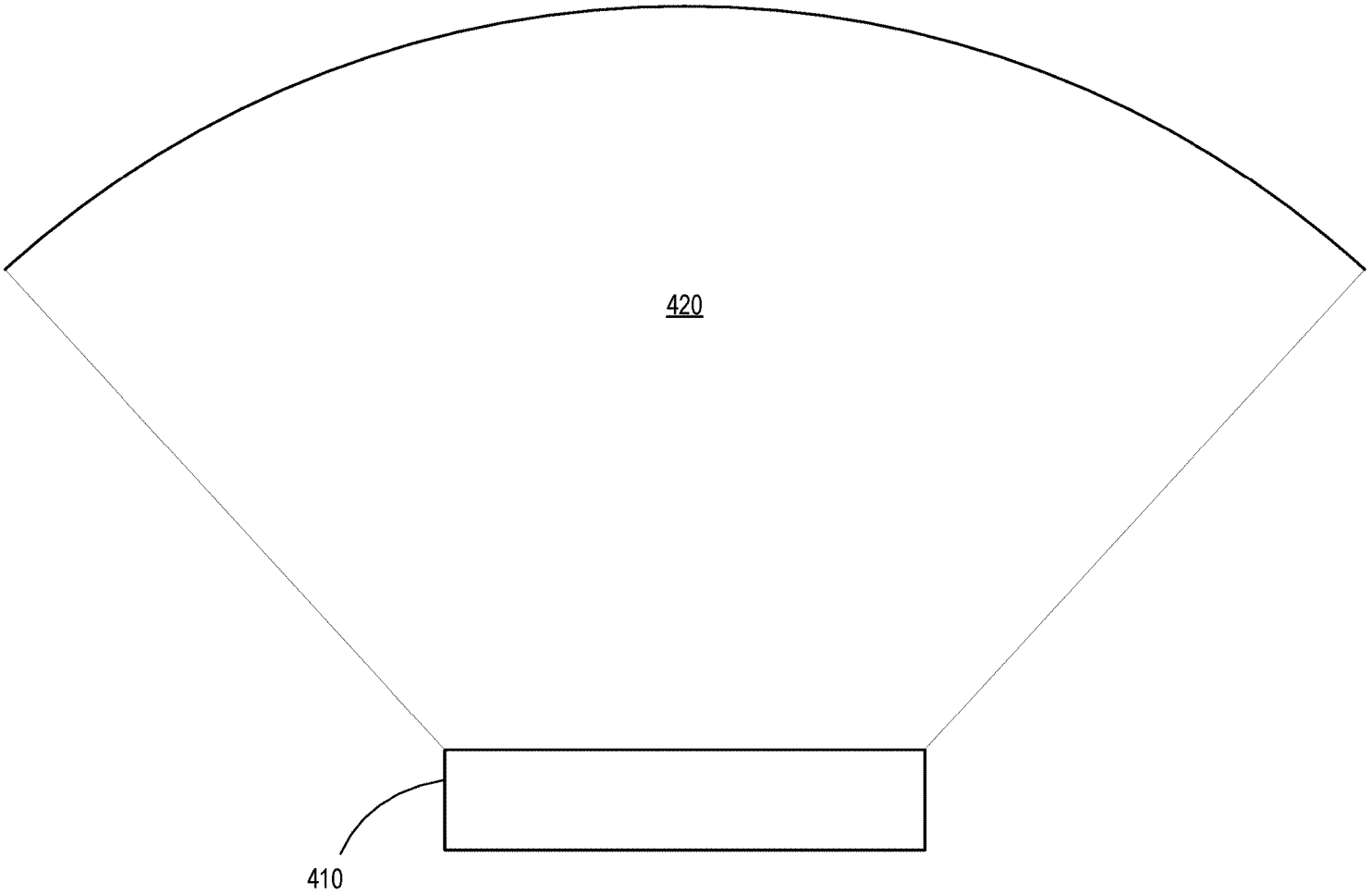
FIG. 4A illustrates a simplified diagram of a coverage area of an antenna system, according to one embodiment.
Figure 4B:
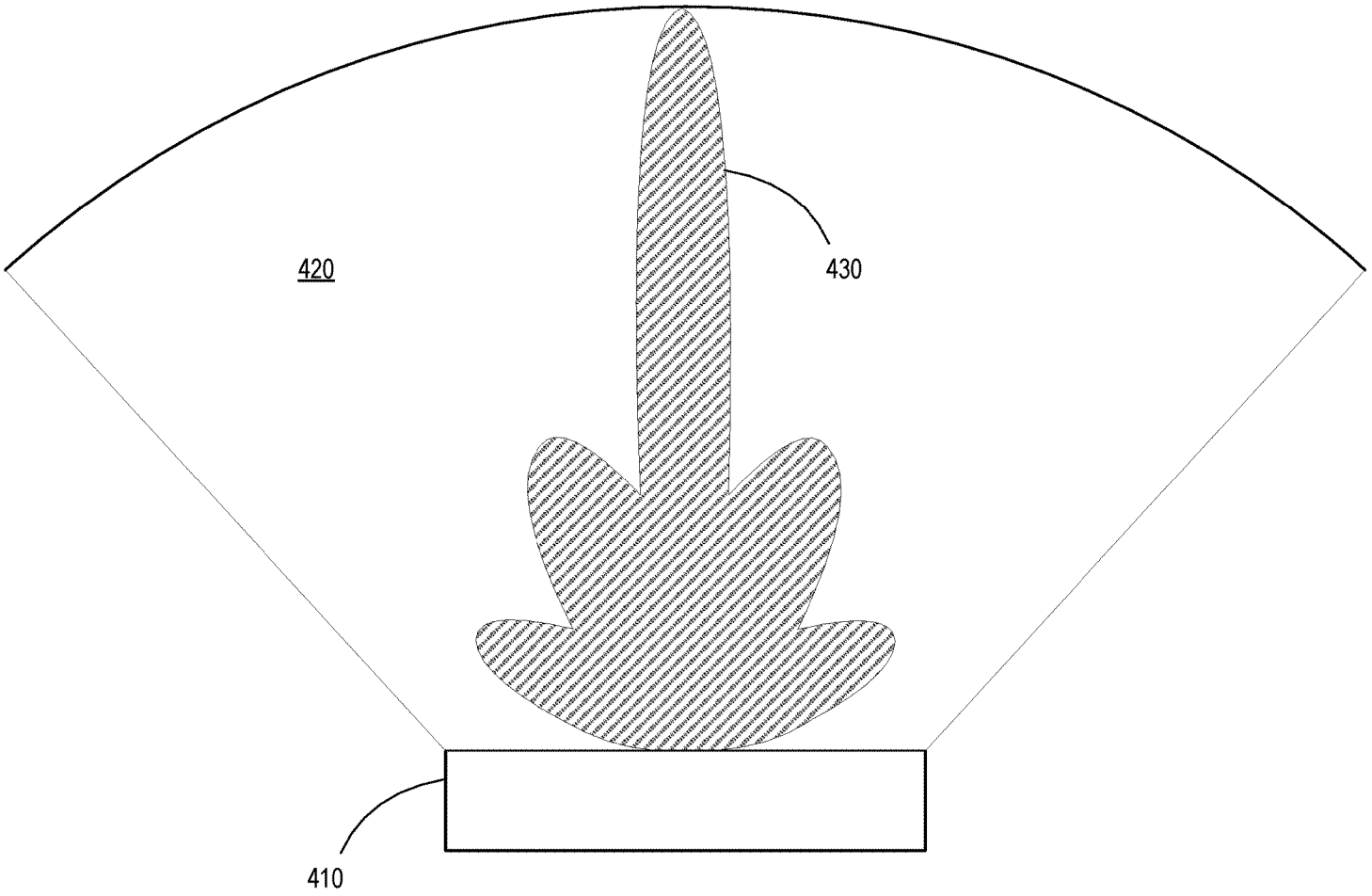
FIG. 4B illustrates a simplified diagram of a field pattern generated by the antenna system within the coverage area, according to one embodiment.

Most practical applications of beamforming can be satisfied by defining a finite number of field patterns to achieve a suitable coverage area with a target directivity within the coverage area. FIG. 4A illustrates an antenna 410 configured to serve coverage area 420. As can be appreciated, one option is to provide an antenna with low directivity such that a single radiation pattern serves the entire coverage area. Such configuration may not be suitable for many applications in which the energy density and/or selectivity of the radiation pattern may be too low. Another option, as illustrated in FIG. 4B is to configure the antenna 410 to provide a beamform 430 with a high directivity within the coverage area 420.

Figure 4C:
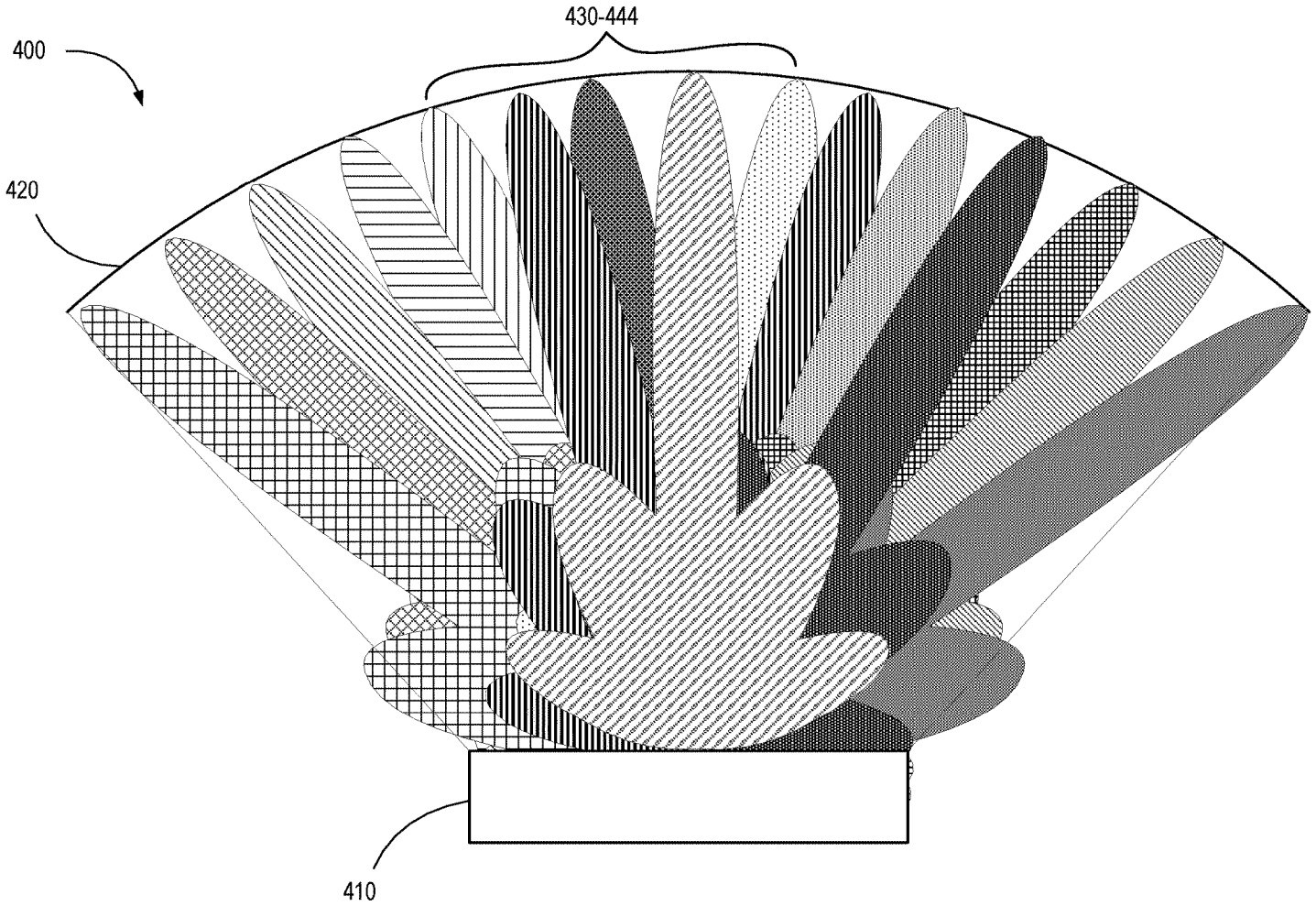
FIG. 4C illustrates a plurality of attainable field patterns of the antenna system within the coverage area, according to one embodiment.

As illustrated in FIG. 4C, to serve the entire coverage area, 420, the beamform may be steered to a plurality of discrete locations, as illustrated by beamforms 430-444. Accordingly, a finite number of field patterns (i.e., beamforms 430-444) can be used to serve the coverage area 420.

A beam with a maximum possible directivity, for an aperture of a given size may be swept through a coverage zone. The coverage area may be defined in three-dimensional space and require sweeping the beam in two directions, or two-dimensionally in which case the sweeping may only be in one direction. For example, a coverage area may be defined as a conical sector of three-dimensional space extending from the antenna with a solid angle, $\Omega_c$. The beamwidth, $\Omega_b$, produced by the antenna with a maximum possible directivity is a function of the aperture size and the Friis directivity.

The beamwidth of such an antenna system can be expressed as:

$$\Omega_b = \frac{4\pi}{D} = \frac{\lambda^2}{A} \qquad \text{Equation 1}$$

In Equation 1, A is the aperture area of the antenna, $\lambda$ is the wavelength of a frequency within an operational bandwidth, and D is the maximum directivity. A beam with a beamwidth, $\Omega_b$, generated by a tunable antenna can be moved or steered around a conical coverage area having a solid angle, $\Omega_c$. The steerable tunable antenna can service the conical coverage area as long as it can produce a sufficient number of distinct field patterns, $N_P$, to serve the entire coverage area. Assuming each field pattern, $N_P$, can be tailored to serve a unique portion of the conical coverage area defined by the solid angle, $\Omega_c$, the minimum number of field patterns can be expressed as:

$$N_P = \Omega_c / \Omega_b \qquad \text{Equation 2}$$

Figure 5A:
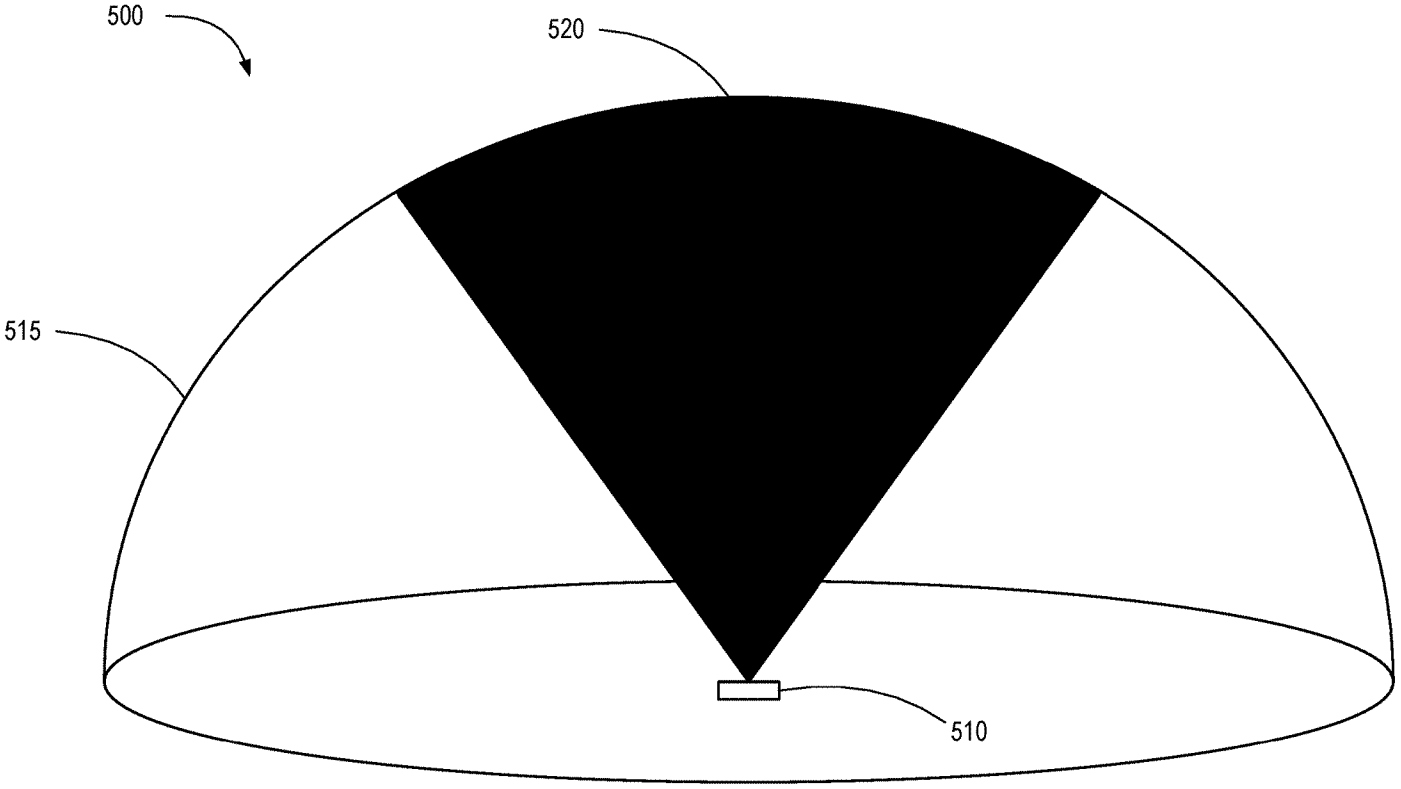
FIG. 5A illustrates a simplified diagram of a potential three-dimensional coverage area of an antenna system, according to one embodiment.

FIG. 5A illustrates a simplified diagram 500 of a potential three-dimensional coverage area 520 of an antenna system 510 within a three-dimensional space 515, according to one embodiment.

Figure 5B:
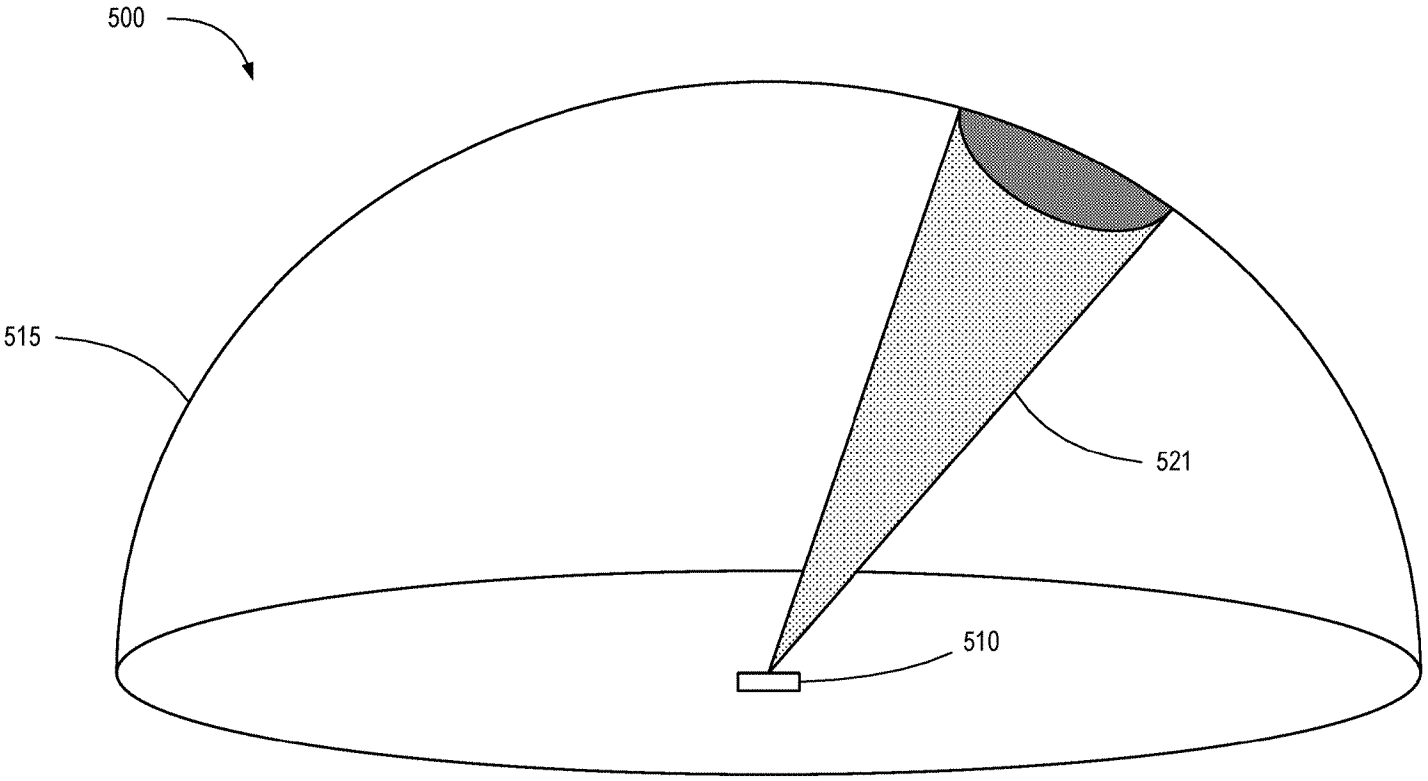
FIG. 5B illustrates a simplified diagram of a conical field pattern of the antenna system within the potential three-dimensional coverage area, according to one embodiment.

FIG. 5B illustrates the simplified diagram 500 with a conical field pattern 510 generated by the antenna system 510 within the three-dimensional space, according to one embodiment.

Figure 5C:
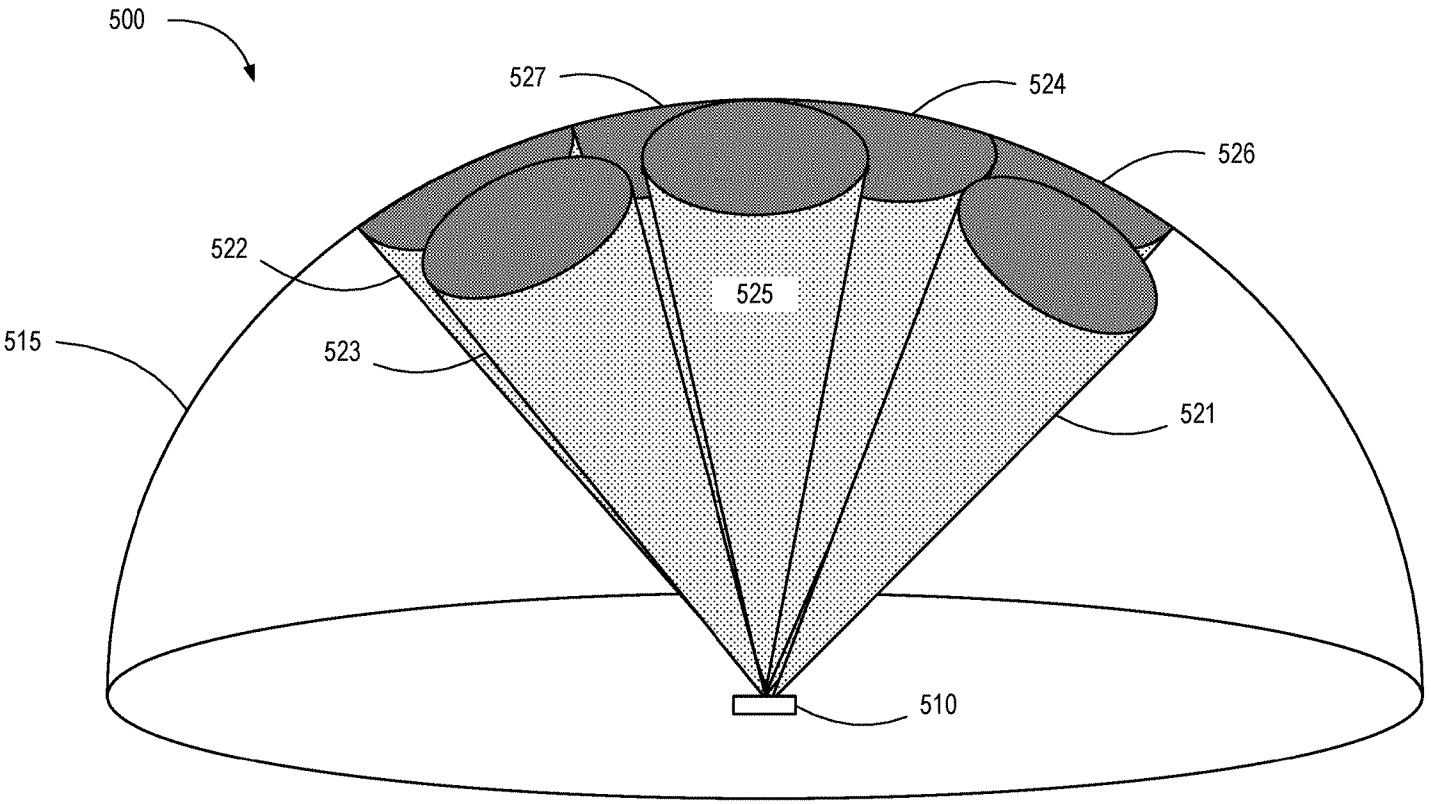
FIG. 5C illustrates a finite number of conical field patterns of the antenna system that can be selectively used to serve the three-dimensional coverage area, according to one embodiment.

FIG. 5C illustrates a finite number of conical field patterns 521-527 that can be selectively generated by the antenna system 510 to serve the three-dimensional coverage area (520, FIG. 5A) within the three-dimensional space 515, according to one embodiment. As can be appreciated, as the directivity of the antenna system 510 increases, the beamwidth, $\Omega_b$, will decrease and the number of beamforms or radiation patterns necessary to serve the entire coverage area will increase.

Conceptually, the coverage area can be approximated as including a finite number of receive locations, $N_R$, to each be served by one field pattern, $N_P$, of a tunable antenna. For an ideal tunable antenna, $N_P = N_R$ and each field pattern, $N_P$, provides a maximum power density at one receive location, $N_R$, and minimum (e.g., zero) power density at all other receive locations.

A matrix of receive amplitudes for each different field pattern of the antenna system can be created that is size $N_P \times N_R$. In the ideal case, $N_P = N_R$ and thus the receive amplitude matrix is square. Each row of the matrix corresponds to received amplitudes for particular receive locations, $N_R$, for a particular field pattern, $N_P$. An ideal antenna system would provide a square matrix with size $N_P \times N_R$ that is a diagonal matrix.

Using the above conceptual approach, an antenna system may be designed to have a number of unique field patterns, $N_P$, to serve a finite number of receive locations, $N_R$. To achieve the desired functionality, the receive amplitude matrix should be as close to a diagonal matrix as possible and should be full rank. Any rank-deficiency in the receive amplitude matrix means that at least one of the receive locations, $N_R$, is not served by a unique field pattern, $N_P$.

With a conventional phased array, the receive amplitude matrix, T, is the product of the channel matrix, H, and an element matrix, U, such that:

$$T = HU \qquad \text{Equation 3}$$

The channel matrix, H, is of size $N_R \times N_{PS}$, wherein $N_R$ is the finite number of receive locations and $N_{PS}$ is the number of tunable phase shifters in the conventional phased array. The element matrix, U, corresponds to the phase factors, $e^{j\varphi}$, associated with each of the tunable phase shifters for each field pattern.

Since the rank of the product of matrices cannot exceed that of the lowest-rank matrix, the number of phase shifters, $N_{PS}$, must be at least as large as the number of field patterns, $N_P$. Each phase shifter corresponds to a unique control input and so a conventional phased array approach, even in an ideal case, cannot reduce the cost and complexity of the tunable element network and its controlling network below its fundamental limit $N_{tun} \geq N_P$ In contrast, a tunable antenna utilizes a tunable network of impedance elements to generate unique field patterns, $N_P$. Thus, the equivalent matrix, T, for a tunable antenna is a function of the sequence of vectors, V, representing the magnitudes of external signals that module the EM properties (e.g., impedance) of the tunable elements, such that:

$$T=T(V) \quad \text{Equation 4}$$

In Equation 4, V is a matrix of size $N_{tun} \times N_P$, where the rows are vectors, $\vec{v}$, of modulating signal strengths. For example, a vector, $\vec{v}$, may be a series of DC bias voltages, mechanical displacements, acoustic wave amplitudes, optical intensities, or any other control input (stimuli) used to modulate the RF properties of the tunable medium beamformer.

Figure 6:
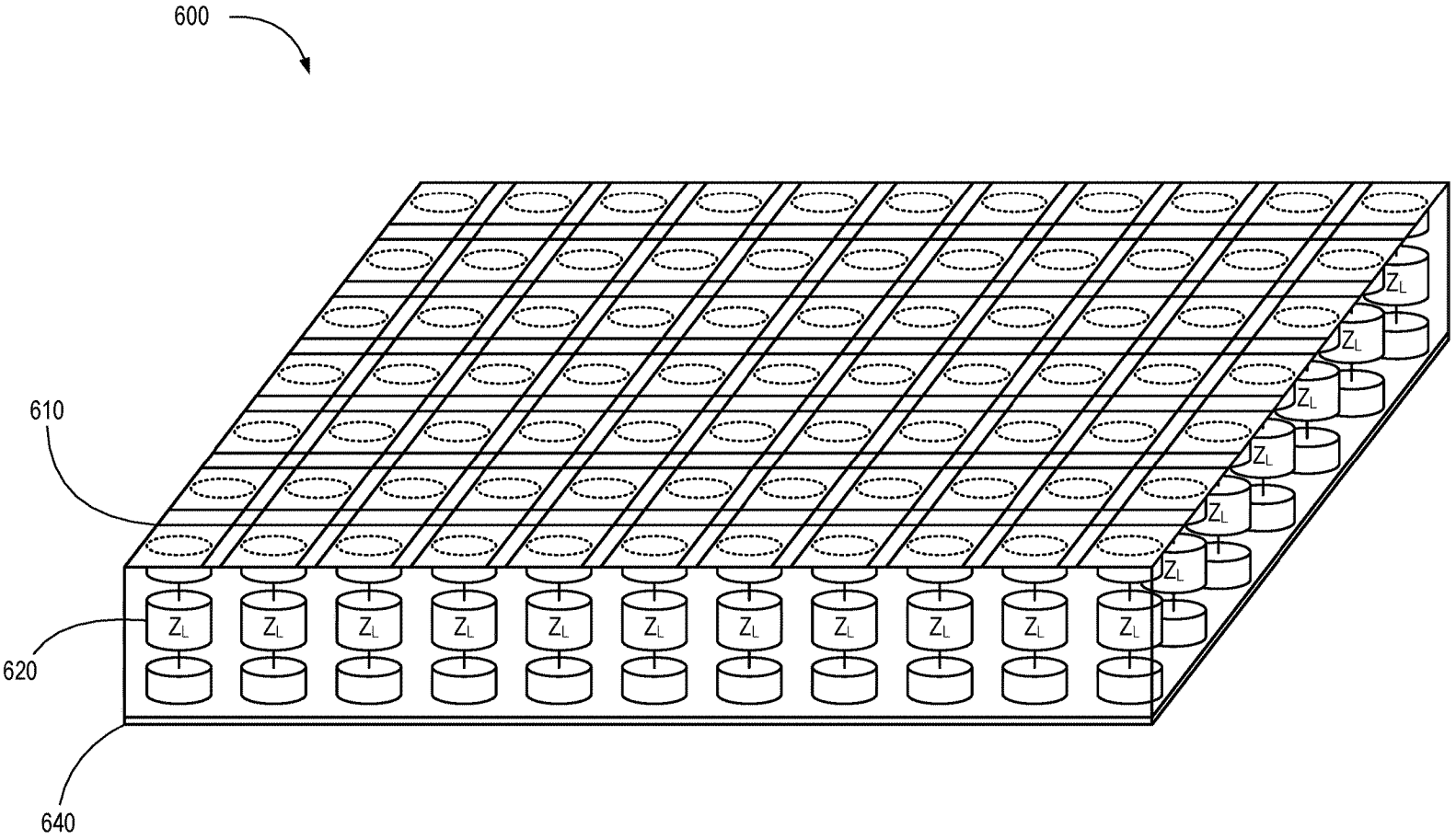
FIG. 6 illustrates a conceptual model of an array of tunable impedance elements coupled to antenna elements, according to one embodiment.
Figure 7:
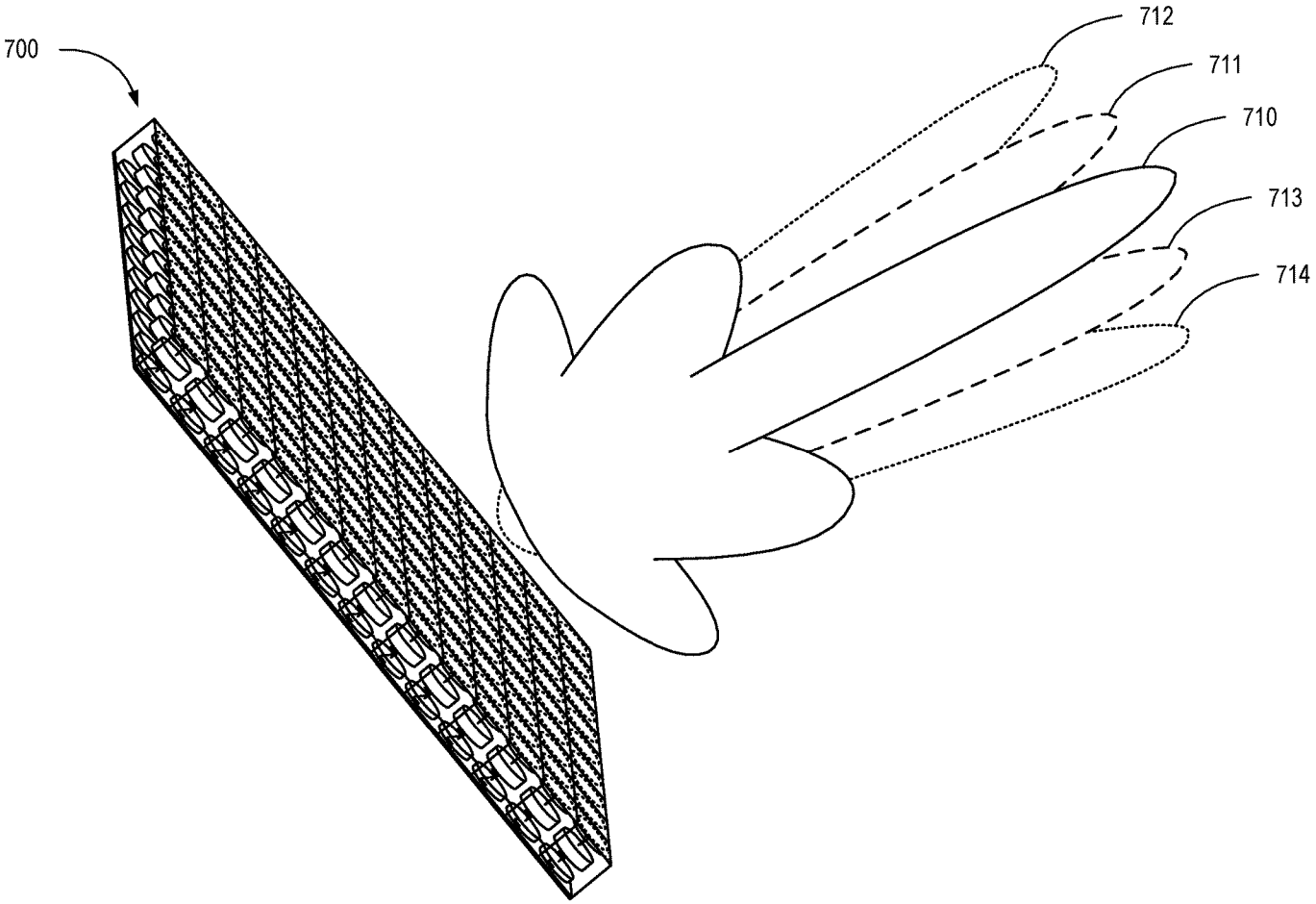
FIG. 7 illustrates an beamform associated with an array of antenna elements coupled to a plurality of tunable impedance elements.

FIG. 6 illustrates an example of a tunable antenna 600 that includes a plurality of antenna elements 610 for scattering an EM wave. The antenna elements 610 are coupled to a feed 640 via a plurality of tunable impedance elements 620 that have a nonlinear response to impedance tuning. As illustrated in FIG. 7, impedance values of the tunable impedance elements can be modulated with various values such that the antenna elements of the antenna system 700 can selectively produce a steerable beamform (710-714).

In the case of the conventional phased array, Equation 3, illustrates that the relationship between the receive amplitude matrix, T, and the parameters controlling beamforming (e.g., the normalized complex amplitudes associated with the phase shifters of a conventional phased array) is linear. In contrast, Equation 4 for an antenna system utilizing a tunable network of impedance elements can be nonlinear and expressed using a Taylor expansion as:

$$T=T_0+T_1V+T_2VV+\ldots \quad \text{Equation 5}$$

In Equation 5 above, $T_1$ is a 4-dimensional array of size $N_P \times N_P \times N_{tun} \times N_P$, $T_2$ is a 6-dimensional array of size $N_P \times N_P \times N_{tun} \times N_P \times N_{tun} \times N_P$, and so on. In general, the $n^{th}$ term in this expansion includes a coefficient array $T_n$ having dimension $N_P^{2+n} \times N_{tun}^{n}$. The expansion coefficient arrays ($T_0$, $T_1$, $T_2$, . . . ) are the static properties of the tunable medium, determined by its microstructure and the materials used. These coefficients may be, for example, controlled by the geometric parameters. The tuning parameter matrix, V, contains all parameters that can be adjusted dynamically after fabrication.

The rank of matrix T in Equation 5 for the antenna system utilizing a tunable network of impedance elements can be much higher than the rank of any individual term in the expansion. This is due to the fact that non-degenerate subspaces of two matrices added together can be orthogonal to each other. Thus, for a system in which there is a substantial number of selectable nonlinear coefficients, $N_{NL}$, in the expansion, the number of control parameters, $N_{tun}$, can be reduced by at least a factor of the cumulative number of selectable nonlinear coefficients, $N_{NL}$. The number of selectable nonlinear coefficients, $N_{NL}$, corresponds to the nonlinear characteristics of the tunable impedance elements. Thus, for a given number of field patterns, $N_P$ the minimum number of control parameters, $N_{tun}$, is reduced by a factor of the cumulative number of selectable nonlinear coefficients, $N_{NL}$, associated with the tunable impedance elements that have a nonlinear response to impedance tuning. For an antenna designed to provide a given number of field patterns, $N_P$, the number of tunable elements may be reduced by a factor of the cumulative number of selectable nonlinear coefficients, $N_{NL}$.

The number of control parameters, $N_{tun}$, required to achieve a given number of field patterns, $N_P$ can be further reduced in embodiment in which at least some of the tunable impedance elements are electromagnetically coupled to each other. In some embodiments, V may be a "rank-deficient" rectangular matrix. In the most extreme case, V may be a single-column vector if a single control parameter, $N_{tun}$, is used (i.e., $N_{tun}=1$). Thus, the rank of V may be far less than $N_P$. However, because the terms in the expansion shown In Equation 5 are not products of rectangular matrices, the rank of $T_1V$ can be a substantial fraction of $N_P$, or even complete (i.e., $\text{rank}(T_1V)=N_P$. In such embodiments, contributions from higher-order terms, such as $T_2VV$ may not be necessary to fill the T-matrix to full rank. Mathematically, the additional degrees of freedom can be found in the "off-diagonal" elements of the rank-4 tensor $T_1$, of which there are roughly $O(N_P^3 N_{tun}/2^4)$.

The non-zero values of these off-diagonal elements are due to mutual coupling between the tunable impedance elements. As described at least in part in U.S. patent application Ser. No. 14/918,331 filed on Oct. 20, 2015 titled "Tunable Metamaterial Systems and Methods", the individual terms in the Taylor expansion in Equation 5 are not functionally independent in the tunable-impedance-network system. Rather, the terms may be expressed by a single admittance matrix and the nonlinear impedance-tuning parameter curves that numerically approximate the responses of the tunable impedance elements that have a nonlinear response to impedance tuning.

Thus, assuming that each tunable impedance element has a unique nonlinear impedance-tuning parameter curve, resulting in a cumulative number of selectable nonlinear coefficients, $N_{NL}$, the total number of degrees of freedom can be approximate as:

$$\frac{N_{tun}^2}{2} + N_{tun} \times N_{NL} \quad \text{Equation 6}$$

The number of degrees of freedom can alternatively be expressed as:

$$N_{tun} \times \left(\frac{N_{tun}}{2} + N_{NL}\right) \quad \text{Equation 7}$$

In practice, mutual coupling between any two elements may be difficult to measure, calculate, and/or control. An approximation can be made by introducing a coordination number, $N_{co}$, corresponding to a number of "neighboring" elements that are strongly coupled to a particular element. As used herein, the term "coordination number" for a port number "n" is based on the number of off-diagonal elements in the n-th row of a Z-matrix satisfying the criterion $|Z_{nm}| >= \varepsilon * Z_0$, where ε is a selected threshold coefficient (for example, 0.1 or 0.01), and $Z_0$ is one of: (i) the free-space impedance (a fundamental constant); (ii) the mean value of the magnitudes of diagonal elements of the matrix Z; or (ii) another kind of matrix norm characteristic of a typical magnitude of Z-values. Additional description of the Z-Matrix and off-diagonal elements relating to the coordination number used herein can be found in U.S. patent application Ser. No. 14/918,331 filed on Oct. 20, 2015 titled "Tunable Metamaterial Systems and Methods," previously incorporated by reference.

Thus, the coordination number will be positive and will not exceed the number of control parameters, $N_{tun}$. For a square array of elements, nearest-neighbor-dominated coupling is equal to four, such that $N_{co}=4$. For hexagonal arrays, the number of nearest-neighbor-dominated coupling may be equal to six, such that $N_{co}=6$. The admittance matrix of such an antenna system may be a block matrix with a number of symmetric blocks equal to the number of control parameters, $N_{tun}$, divided by the coordination number, where each block has a size $N_{co}\times N_{co}$. The total number of independent degrees of freedom of such a system is expressible as:

$$\frac{N_{co}^2}{2} * N_{tun} / N_{co} \qquad \text{Equation 8}$$

The number of degrees of freedom of the system can alternatively be expressed as:

$$N_{tun} \times \frac{N_{co}}{2} \qquad \text{Equation 9}$$

Combing the total number of degrees of freedom from mutual coupling with the selectable nonlinear coefficients associated with the individual tunable impedance elements that have a nonlinear response to impedance tuning, the total number of degrees of freedom can be expressed as:

$$N_{tun} \times \left(\frac{N_{co}}{2} + N_{NL}\right) \qquad \text{Equation 10}$$

As previously described, for a given antenna directivity and desired coverage area, a minimum number of unique field patterns may be required. For the necessary number of filed patterns, $N_P$, a conventional phased array antenna system requires an equal number of control parameters, $N_{tun}$. Using this traditional approach, a design for a tunable antenna system with a plurality of tunable impedance elements may include more control parameters than necessary. Given the cost and complexity associated with the number of control parameters, it may be desirable to minimize, or at least reduce, the number of control parameters. By utilizing tunable impedance elements that have nonlinear responses to impedance tuning and/or exhibit mutual coupling to at least nearest-neighbors, the number of control parameters may be reduced by at least a factor of $$\frac{N_{co}}{2} + N_{NL}.$$

For instance, in various embodiments, advantages over a traditional phased array may be attained when the number of tunable elements is less than the physical antenna aperture area divided by half of a largest wavelength of an operational frequency of the antenna system, squared. In such an embodiment, the number of tunable elements will be less than the number of phase shifters that would be required in a similarly capable phased array. That is, a conventional phased array may require at least a number of phase shifters, $P_s$, equal to the aperture of the area, A, of the antenna system divided by half of a wavelength (λ) squared, such that $P_s=A/(\lambda/2)^2$. In contrast, various embodiments of the antenna systems described herein allow for the number of control parameters, $N_{tun}$, (e.g., tunable impedance elements that have a nonlinear response to impedance tuning) to be significantly less than the equivalent number of phase shifters in a conventional phased array. As an example, the number of tunable impedance element, $N_{tun}$, may be less than the area, A, of the antenna system divided by half of a wavelength (λ), squared, such that $N_{tun}<A/(\lambda/2)^2$, or even much less, such that that $N_{tun}<<A/(\lambda/2)^2$.

In the equations above, a total number of control parameters, $N_{tun}$, is reduced with the assumption that there is a one-to-one correspondence between control lines and the tunable impedance elements controlled by them. However, in some embodiments, multiple tunable impedance elements are controlled by one control line. In such embodiments case the number of tunable lumped elements associated with the control parameters, $N_{tun}$, and the actual number of control lines, $N_{CL}$ may vary. In such instances, the number of control lines $N_{CL}$ should be used in place of the control parameter, $N_{tun}$, in each of Equations 4-6. However, the number of ports in the admittance matrix is still equal to the number of control parameters, $N_{tun}$, not the number of control lines, $N_{CL}$. Thus, Equations 7-10 remain the same with the control parameters, $N_{tun}$, correspond to the number of unique tunable elements, but not the number of control lines, $N_{CL}$.

In one embodiment, a number of resonators are evanescently coupled to a microstrip line, with each resonator having a variable impedance element. For example, each resonator may be coupled to a varactor, a liquid crystal-filled capacitor, a transistor, or other element that has a variable and nonlinear impedance. Each variable impedance element may be connected (in series or parallel) to a controlling bias line. The static geometric properties of each resonator are selectable via the controlling bias line. The selectable static geometric properties may translate into a number of resonant frequencies, oscillator strengths and oscillator damping constants for each resonance affecting the system at a given frequency.

In another embodiment, a single-mode, a multi-mode or a parallel-plate waveguide is patterned with complementary metamaterial surfaces, having a number of tunable resonant elements.

In another embodiment, a number of resonators are inserted into a multimode, resonant cavity. The walls of the cavity can be formed by one or more of conductive materials, high-index dielectric materials, and/or effective-impedance meta-surfaces. The cavity may be configured with one or more feed points for radiation to "leak" into and/or out of the cavity to other parts of the antenna system. The properties of resonances of the cavity, such as the resonance frequency, oscillator strength, and/or damping rate for each resonance are selectable by choosing the geometric parameters of the cavity. For example, resonance properties may be statically selected by modifying the shape of the cavity walls. Cavity walls may include effective impedance meta-surfaces, the properties of which may be selected by choosing the properties of the meta-surfaces themselves and/or their distribution on the cavity walls.

In another embodiment, tunable resonators are inserted into a micro-ring or a microsphere resonator. Such resonators may be manufactured as a high dielectric-constant material surrounded by a lower dielectric constant media (e.g. air). Such resonators may be particularly suited for operating frequencies in the optical range.

In another embodiment, an azimuthal array of resonators is arranged in a toroidal fashion, with each element biased by a single tunable impedance element on the axis of the toroid. For example, a plurality of resonant rings may be connected to a single nonlinearly tunable capacitor. In another embodiment, a transmission line or a waveguide may utilize a variable-dielectric-constant material as a substrate or wall material. The entire substrate or portions thereof may be biased by one or more control lines. In another embodiment, a resonant cavity or a waveguide may include at least one mechanically reconfigurable wall. The position of the wall may affect the resonant properties of the cavity. The mechanically reconfigurable wall may be repositioned via DC-actuated components, motors, piezoelectric actuators, electrostatic (MEMS) actuators, liquid metals, and/or the like.

The systems and methods described above allow for an antenna system that provides a suitable number of degrees of freedom with a reduced number of control parameters. Such an antenna system may include a plurality of an antenna elements, a feed, and a tunable port network selectively connecting the feed to the antenna elements.

The tunable port network may include a plurality of tunable impedance elements that each have a nonlinear response to impedance tuning. As described above the plurality of tunable impedance elements can be numerically approximated by nonlinear impedance-tuning parameter curves with a cumulative number of selectable nonlinear coefficients. The antenna system may be described as including a plurality of control inputs to nonlinearly vary the impedance of the tunable impedance elements to allow for selection of each of a plurality of distinct impedance patterns of the tunable port network.

Each distinct impedance pattern of the tunable port network corresponds to one of a plurality of distinct field patterns attainable by the antenna system. As previously noted, the number of distinct field patterns attainable is a function of the number of control inputs and the cumulative number of selectable nonlinear coefficients associated with the plurality of tunable impedance elements. Thus, for a target number of field patterns, the complexity of the antenna system may be reduced by reducing the number of control inputs possible via the tunable impedance elements. Similarly, for a target number of field patterns, the complexity of the antenna system may be reduced by reducing the number of tunable impedance elements by increasing the number of selectable nonlinear impedance values.

In various embodiments, at least some of the tunable impedance elements are tunable via a direct current (DC) input and have a nonlinear impedance response to changes in the voltage magnitude of the DC input. In some embodiments, the tunable port network includes at least one linear tunable impedance element that has a linear response to impedance tuning. In various embodiments, the tunable impedance elements may have a nonlinear impedance response to any of a wide variety of electrical, pressure, thermal, optical, and/or other input. For example, the tunable impedance elements may be tunable via alternating current (AC) inputs and have nonlinear impedance responses to changes in a voltage magnitude of the AC input. The tunable impedance elements may be tunable via mechanical pressure inputs and have nonlinear impedance responses to changes in pressure magnitudes.

The tunable impedance elements may be tunable via sound pressure inputs and have nonlinear impedance responses to changes in sound pressure magnitudes. The tunable impedance elements may be tunable via light inputs and have nonlinear impedance responses to changes in light intensity. The tunable impedance elements may be tunable based on temperature inputs (e.g., conducted or radiated heat) and have nonlinear impedance responses to changes in temperature.

In some embodiments, the number of antenna elements is equal to the number of tunable impedance elements in the tunable port network. The number of control inputs may be fewer than the number of tunable impedance elements. The number of antenna elements may be greater than the number of tunable impedance elements, and some of the tunable impedance elements may be in communication with multiple antenna elements.

The number of control inputs and/or tunable elements may be selected based on a number of distinct field patterns corresponding to a target coverage area of the antenna system divided by a function of the cumulative number of selectable nonlinear coefficients. For instance, the number of control inputs and/or tunable elements may be selected based on a number of distinct filed patterns corresponding to a target coverage area of the antenna scaled by the cumulative number of selectable nonlinear coefficients.

More specifically, the number of distinct field patterns for the target coverage area may be equal to the minimum number of distinct field patterns for the target coverage area, given the directivity (and corresponding beamwidth) of the antenna system. At least some of the antenna elements may be subwavelength relative to a frequency within an operational bandwidth and/or be spaced at subwavelength intervals.

In various embodiments, the impedance of each of the tunable impedance elements may be numerically approximated by a unique nonlinear impedance-tuning curve with at least two selectable nonlinear coefficients, such that the cumulative number of selectable nonlinear coefficients is greater than number of tunable impedance elements. In some embodiments, the impedance of each of the tunable impedance elements can be numerically approximated by a nonlinear impedance-tuning curve with at least two unique and selectable nonlinear coefficients, such that the cumulative number of selectable nonlinear coefficients is at least twice the number of tunable impedance elements.

In various embodiments, the number of control inputs is equal to the number of tunable impedance elements, such that each tunable impedance element can be independently tuned via a unique impedance element control input. The number of control inputs may be less than the number of tunable impedance elements, and at least one of the control inputs may affect the impedance tuning of multiple tunable impedance elements.

The antenna system may part of a multiple input, multiple output (MIMO) system. One or more control inputs may be provided as an alternating current input, an optical radiation input, a thermal radiation input, an acoustic wave input, mechanical pressure input, and/or a mechanical contact input.

The antenna system may include a control system in communication with the plurality of control inputs to control radiation patterning of the antenna system based on a scattering matrix (S-Matrix) of electromagnetic field amplitudes for each of a plurality of lumped ports as described in the applications incorporated by reference herein. As previously noted, the antenna elements may comprise a metamaterial and the tunable impedance elements may comprise one or more of a resistor, a capacitor, an inductor, a varactor, a diode, and a transistor.

Many existing computing devices and infrastructures may be used in combination with the presently described systems and methods. Some of the infrastructure that can be used with embodiments disclosed herein is already available, such as general-purpose computers, computer programming tools and techniques, digital storage media, and communication links. A computing device or controller may include a processor, such as a microprocessor, a microcontroller, logic circuitry, or the like.

A processor may include a special-purpose processing device, such as application-specific integrated circuits (ASIC), programmable array logic (PAL), programmable logic array (PLA), programmable logic device (PLD), field programmable gate array (FPGA), or other customizable and/or programmable device. The computing device may also include a machine-readable storage device, such as non-volatile memory, static RAM, dynamic RAM, ROM, CD-ROM, disk, tape, magnetic, optical, flash memory, or other machine-readable storage medium. Various aspects of certain embodiments may be implemented using hardware, software, firmware, or a combination thereof.

The components of the disclosed embodiments, as generally described and illustrated in the figures herein, could be arranged and designed in a wide variety of different configurations. Furthermore, the features, structures, and operations associated with one embodiment may be applicable to or combined with the features, structures, or operations described in conjunction with another embodiment. In many instances, well-known structures, materials, or operations are not shown or described in detail to avoid obscuring aspects of this disclosure.

This disclosure has been made with reference to various exemplary embodiments, including the best mode. However, those skilled in the art will recognize that changes and modifications may be made to the exemplary embodiments without departing from the scope of the present disclosure. While the principles of this disclosure have been shown in various embodiments, many modifications of structure, arrangements, proportions, elements, materials, and components may be adapted for a specific environment and/or operating requirements without departing from the principles and scope of this disclosure. These and other changes or modifications are intended to be included within the scope of the present disclosure.

This disclosure is to be regarded in an illustrative rather than a restrictive sense, and all such modifications are intended to be included within the scope thereof. Likewise, benefits, other advantages, and solutions to problems have been described above with regard to various embodiments. However, benefits, advantages, solutions to problems, and any element(s) that may cause any benefit, advantage, or solution to occur or become more pronounced are not to be construed as a critical, required, or essential feature or element.

What is claimed is:

1. An antenna system, comprising:

a plurality of antenna elements;

a feed to convey an electromagnetic (EM) signal;

a tunable port network coupling the feed to the plurality of antenna elements, wherein the tunable port network comprises a plurality of tunable impedance elements that each have a nonlinear response to impedance tuning, wherein the plurality of tunable impedance elements can be numerically approximated by nonlinear impedance-tuning parameter curves with a cumulative number of selectable nonlinear coefficients; and a plurality of control inputs to nonlinearly vary impedance values of the tunable impedance elements with nonlinear responses to impedance tuning to allow for selection of each of a plurality of distinct impedance patterns of the tunable port network, wherein each of the plurality of distinct impedance patterns of the tunable port network corresponds to one of a plurality of distinct field patterns attainable by the antenna system, and wherein the number of distinct field patterns attainable is a function of the number of control inputs and the cumulative number of selectable nonlinear coefficients associated with the plurality of tunable impedance elements.

2. The system of claim 1, wherein at least some of the cumulative number of selectable nonlinear coefficients are selected from a range of values by selecting an internal structure of at least some of the tunable impedance elements.

3. The system of claim 1, wherein an impedance of each of the tunable impedance elements is numerically approximated by a nonlinear impedance-tuning curve with at least two unique selectable nonlinear coefficients, such that the cumulative number of selectable nonlinear coefficients is at least twice the number of tunable impedance elements.

4. The system of claim 1, wherein the number of tunable elements is selected to satisfy the expression $$N_p = N_{tun} \times \left(\frac{N_{tun}}{2} + N_{NL}\right),$$

where $N_p$ is the number of distinct field patterns, $N_{tun}$ is the number of tunable elements, and $N_{NL}$ is the cumulative number of selectable nonlinear coefficients.

5. The system of claim 1, wherein the number of tunable elements is selected to be equal to the number of distinct field patterns attainable divided by the cumulative number of selectable nonlinear coefficients, such that $N_{tun}=N_P/N_{NL}$, where $N_{tun}$ is the number of tunable elements, $N_p$ is the number of distinct field patterns, and $N_{NL}$ is the cumulative number of selectable nonlinear coefficients.

6. The system of claim 1, wherein at least one of the tunable impedance elements is tunable via direct current (DC) input and has a nonlinear impedance response to changes in a voltage magnitude of the DC input.

7. The system of claim 1, wherein at least one of the tunable impedance elements is tunable via an alternating current (AC) input and has a nonlinear impedance response to changes in a voltage magnitude of the AC input.

8. The system of claim 1, wherein at least one of the tunable impedance elements is tunable via mechanical inputs and has a nonlinear impedance response to changes in a mechanical configuration provided by the mechanical input.

9. The system of claim 1, wherein some of the tunable impedance elements are tunable via mechanical inputs and have a nonlinear impedance response to changes in a mechanical configuration provided by the mechanical input.

10. The system of claim 1, wherein the number of control inputs is fewer than the number of tunable impedance elements.

11. The system of claim 10, wherein at least some of the tunable impedance elements are coupled to a single microstrip control line input.

12. The system of claim 10, wherein at least some of the tunable impedance elements are patterned on a waveguide as a plurality of resonant elements.

13. The system of claim 1, wherein the number of control inputs is selected based on a number of distinct field patterns corresponding to a target coverage area of the antenna system scaled by the cumulative number of selectable nonlinear coefficients.

14. The system of claim 1, wherein each of the tunable impedance elements exhibits mutual coupling with at least two neighboring tunable impedance elements, such that a coordination number, $N_{co}$, associated with the plurality of tunable impedance elements is at least two.

15. The system of claim 1, wherein the number of control inputs is less than the number of tunable impedance elements, and wherein at least one of the control inputs affects the impedance tuning of multiple tunable impedance elements.

16. The system of claim 15, wherein at least one of the control inputs is connected in series to at least two of the tunable impedance elements.

17. The system of claim 15, wherein at least some of the antenna elements comprise resonant antenna elements.

18. The system of claim 17, wherein the at least one resonant antenna element and at least one tunable impedance element form a tunable resonant element, and wherein the antenna system comprises a waveguide patterned with tunable resonant elements.

19. The system of claim 17, wherein the at least one resonant antenna element and at least one tunable impedance element form a tunable resonant element, and wherein the antenna system comprises a multimode resonant cavity patterned with tunable resonant elements.

20. The system of claim 19, wherein the multimode resonant cavity comprises walls formed from effective impedance metasurface materials with target effective impedance for an operational bandwidth.

21. The system of claim 19, wherein the multimode resonant cavity is configured with geometric parameter corresponding to a target resonance property.

22. The system of claim 1, further comprising a control system in communication with the plurality of control inputs to control radiation patterning of the antenna system based on a scattering matrix (S-Matrix) of electromagnetic field amplitudes for each of a plurality of lumped ports, wherein the plurality of lumped ports includes:

a plurality of lumped antenna ports with impedance values corresponding to the impedance values of each of the tunable impedance elements; and at least one external port located physically external to the antenna device.

23. The system of claim 22, wherein the control system is configured to control radiation patterning of the antenna system based on the S-Matrix by:

identifying a target electromagnetic radiation pattern of the wireless power transmitter defined in terms of target electromagnetic field amplitudes in the S-Matrix for the at least one external port;

determining an optimized port impedance vector $\{z_n\}$ of impedance values for each of the lumped antenna ports that results in an S-Matrix element for the at least one lumped external port that approximates the target electromagnetic field amplitude for an operating frequency; and adjusting at least one of the plurality of control inputs to modify the impedance value of at least one of the plurality of tunable impedance elements based on the determined optimized $\{z_n\}$.

24. An antenna system for structured illumination imaging, comprising:

a plurality of antenna elements configured to operate within a quasi-monochromatic frequency range;

a feed to convey a substantially continuous wave (CW) electromagnetic (EM) signal;

a tunable port network coupling the feed to the plurality of antenna elements, wherein the tunable port network comprises a plurality of tunable impedance elements that each have a nonlinear response to impedance tuning, wherein the plurality of tunable impedance elements can be numerically approximated by nonlinear impedance-tuning parameter curves with a cumulative number of selectable nonlinear coefficients; and a plurality of control inputs to nonlinearly vary impedance values of the tunable impedance elements with nonlinear responses to impedance tuning to allow for selection of each of a plurality of distinct impedance patterns of the tunable port network, wherein each of the plurality of distinct impedance patterns of the tunable port network corresponds to one of a plurality of distinct illumination patterns in a transmit mode and one of a plurality of distinct coded-aperture patterns in a receive mode, and wherein the number of distinct illumination and coded-aperture patterns attainable is a function of the number of control inputs and the cumulative number of selectable nonlinear coefficients associated with the plurality of tunable impedance elements.

25. The system of claim 24, wherein the quasi-monochromatic frequency range is a frequency range selected from between approximately 1 GHz and 100 GHz.

26. A subsurface imaging antenna system for subsurface imaging (SSI), comprising:

a plurality of antenna elements;

a feed to convey an electromagnetic (EM) signal at one or more selectable frequencies suitable for penetrating a material object, wherein selection of the one or more selectable frequencies is based on a desired material object penetration depth and a desired image resolution;

a tunable port network coupling the feed to the plurality of antenna elements, wherein the tunable port network comprises a plurality of tunable impedance elements that each have a nonlinear response to impedance tuning at the one or more selectable frequencies for material object penetration, wherein the plurality of tunable impedance elements can be numerically approximated by nonlinear impedance-tuning parameter curves with a cumulative number of selectable nonlinear coefficients; and a plurality of control inputs to nonlinearly vary impedance values of the tunable impedance elements with nonlinear responses to impedance tuning to allow for selection of each of a plurality of distinct impedance patterns of the tunable port network, wherein each of the plurality of distinct impedance patterns of the tunable port network corresponds to one of a plurality of distinct illumination patterns in a transmit mode and one of a plurality of distinct coded-aperture patterns in a receive mode, and wherein the number of distinct illumination and coded-aperture patterns attainable is a function of the number of control inputs and the cumulative number of selectable nonlinear coefficients associated with the plurality of tunable impedance elements.

27. The system of claim 26, wherein the subsurface imaging comprises ground-penetrating imaging.

28. The system of claim 27, wherein the material object comprises at least one of: soil, concrete, asphalt, sediment, gravel, rock, and ground water.

29. A method of manufacturing an antenna system, comprising:

provisioning a plurality of antenna elements;

provisioning a feed to convey an electromagnetic signal;

provisioning a tunable port network to couple the plurality of antenna elements to an electromagnetic feed, wherein the tunable port network includes a plurality of tunable impedance elements that each have a nonlinear response to impedance tuning, numerically approximating the plurality of tunable impedance elements via nonlinear impedance-tuning parameter curves with a cumulative number of selectable nonlinear coefficients;

provisioning a plurality of control inputs to nonlinearly vary impedance values of the tunable impedance elements with nonlinear responses to impedance tuning to allow for selection of each of a plurality of distinct impedance patterns of the tunable port network, wherein each of the plurality of distinct impedance patterns of the tunable port network corresponds to one of a plurality of distinct field patterns attainable by the antenna system; and identifying a target number of attainable distinct field patterns;

selecting at least one of: (i) the number of control inputs and (ii) tunable impedance elements with the cumulative number of selectable nonlinear coefficients, to allow for the attainment of the target number of attainable distinct field patterns.

30. The method of claim 29, further comprising: selecting an internal structure of at least some of the tunable impedance elements.

31. The method of claim 29, further comprising, numerically approximating an impedance of each of the tunable impedance elements by a nonlinear impedance-tuning curve with at least two selectable nonlinear coefficients, such that the cumulative number of selectable nonlinear coefficients is greater than number of selectable tunable impedance elements.

32. The method of claim 29, wherein each of the tunable impedance elements exhibits mutual coupling with at least two neighboring tunable impedance elements, such that a coordination number, $N_{co}$, associated with the plurality of tunable impedance elements is at least two.

33. The method of claim 32, further comprising, selecting the number of tunable impedance elements based on the number of distinct field patterns corresponding to the coverage area divided by a function of the sum of (i) the cumulative number of selectable nonlinear coefficients and (ii) half the coordination number.

34. The method of claim 29, further comprising controlling radiation patterning of the antenna system based on a scattering matrix (S-Matrix) of electromagnetic field amplitudes for each of a plurality of lumped ports, wherein the plurality of lumped ports includes:

a plurality of lumped antenna ports with impedance values corresponding to the impedance values of each of the tunable impedance elements; and at least one external port located physically external to the antenna device.

35. The method of claim 34, further comprising controlling radiation patterning of the antenna system based on the S-Matrix by:

identifying a target electromagnetic radiation pattern of the wireless power transmitter defined in terms of target electromagnetic field amplitudes in the S-Matrix for the at least one external port;

determining an optimized port impedance vector $\{z_n\}$ of impedance values for each of the lumped antenna ports that results in an S-Matrix element for the at least one lumped external port that approximates the target electromagnetic field amplitude for an operating frequency; and adjusting at least one of the plurality of control inputs to modify the impedance value of at least one of the plurality of tunable impedance elements based on the determined optimized $\{z_n\}$.

* * * * *